US008732903B2

(12) United States Patent
Splinter

(10) Patent No.: US 8,732,903 B2
(45) Date of Patent: May 27, 2014

(54) CLEANING NOZZLE AND METHOD FOR VACUUM CLEANING

(75) Inventor: Alexander Poul Splinter, Leiden (NL)

(73) Assignee: Koninklijke Philips N.V., Eindhoven (NL)

( * ) Notice: Subject to any disclaimer, the term of this patent is extended or adjusted under 35 U.S.C. 154(b) by 814 days.

(21) Appl. No.: 12/519,383

(22) PCT Filed: Dec. 14, 2007

(86) PCT No.: PCT/IB2007/055118

§ 371 (c)(1),
(2), (4) Date: Jun. 16, 2009

(87) PCT Pub. No.: WO2008/078238

PCT Pub. Date: Jul. 3, 2008

(65) Prior Publication Data

US 2010/0108098 A1 May 6, 2010

(30) Foreign Application Priority Data

Dec. 21, 2006 (EP) ..... 06126766

(51) Int. Cl.
*A47L 9/02* (2006.01)

(52) U.S. Cl.
USPC ..... 15/415.1; 15/319

(58) Field of Classification Search
USPC ..... 15/245, 319, 365, 371, 373, 399, 401, 15/415.1, 418
See application file for complete search history.

(56) References Cited

U.S. PATENT DOCUMENTS

| | | | | |
|---|---|---|---|---|
| 2,047,677 | A * | 7/1936 | Edstrom | 15/373 |
| 3,950,815 | A | 4/1976 | Fukuchi et al. | |
| 5,568,589 | A * | 10/1996 | Hwang | 706/52 |
| 6,591,448 | B1 | 7/2003 | Eklund et al. | |
| 2004/0216267 | A1 | 11/2004 | Kaffenberger et al. | |

FOREIGN PATENT DOCUMENTS

| | | | |
|---|---|---|---|
| DE | 3732483 | A1 | 4/1989 |
| DE | 4412988 | A1 | 10/1995 |
| DE | 102005061646 | A1 | 6/2007 |
| EP | 1330978 | A2 | 12/2002 |
| FR | 2442617 | | 11/1978 |
| JP | 52149870 | A | 12/1977 |
| WO | 9715224 | | 5/1997 |
| WO | 0154555 | A1 | 8/2001 |
| WO | 02074150 | A1 | 9/2002 |
| WO | 2005074779 | A1 | 8/2005 |

* cited by examiner

*Primary Examiner* — Robert Scruggs

(57) ABSTRACT

The invention relates to a vacuum cleaner nozzle (1) bounding an inlet (2) for guiding aspirated air through the nozzle (1). The nozzle (1) comprises a rim (3, 4) along an outer end contour of the inlet (2) for contacting a floor surface area (6) when in an operating position on the floor surface (6), wherein at least a rim portion (3, 4) is movable between a lowered position for contacting a floor surface (6) and a lifted position for leaving a spacing between the rim portion (3, 4) and the floor surface (6). A rim operating structure (21) is adapted for leaving the rim portion (3, 4) in the lowered position during an initial portion of a movement stroke of the nozzle over the floor surface (6) in a direction and for subsequently, during a later portion of the stroke, starting the lifting to the lifted position. This improves the aspiration of larger particles.

12 Claims, 4 Drawing Sheets

CLEANING NOZZLE AND METHOD FOR VACUUM CLEANING

FIELD OF THE INVENTION

The invention relates to a vacuum cleaner nozzle bounding an inlet for guiding aspirated air through the nozzle and to a method for vacuum cleaning.

BACKGROUND OF THE INVENTION

From WO97/15224, a vacuum cleaner nozzle is known that is equipped with a rim extending along an outer end contour of the inlet for contacting a floor surface area when in an operating position on the floor surface. A portion of the rim is movable between a lowered position for contacting a floor surface or extending close to the floor surface and a lifted position for leaving spacing between the rim portion and the floor surface. A rim operating structure is provided for lifting and lowering the rim portion between the lowered position and the lifted position in a movement stroke of the nozzle over the floor surface in a direction.

The rim operating structure includes a tongue engaging the floor surface. The tongue is pivotably movable in a directions generally parallel to the direction of movement of the nozzle over the floor surface between two positions. The tongue is connected to two rim portions on opposite sides if the inlet end contour for keeping lifted one of the nozzles in a first of the two positions and for keeping lifted the other one of the nozzles in the other of the two positions. Each time, a movement stroke of the nozzle over the floor in a direction opposite to the previous stroke is started, frictional forces between the tongue and the floor surface cause the tongue to be pivoted to the other of the two positions and lifts the other, now leading one of the rim portions to the lifted position. Thus, the rim portions are each time lifted at the start of a stroke in a new direction. This allows larger particles to enter the contour of the outer end of the inlet, while the trailing rim slides over the floor, so that the nozzle does not have to be lifted from the floor and positioned over larger particles to be able to aspirate such larger particles.

From WO01/54555, a similar vacuum cleaner nozzle is known. In this vacuum cleaner nozzle, frictional forces between the rim portions and the floor surface cause the leading rim portion to be lifted from the floor each time when a stroke over the floor in a new directions opposite to the direction of a previous stoke is started.

A disadvantage of such known vacuum cleaner nozzles is that fine dust and other dirt adhering to the floor surface are removed from the floor surface less effectively.

SUMMARY OF THE INVENTION

It is an object of the present invention to provide a solution that allows to aspirate larger particles during vacuum cleaning without lifting the vacuum cleaner nozzle from the floor, but in which fine dust and other dirt are removed from a floor surface more effectively.

According to one aspect of the invention, this object is achieved by providing a vacuum cleaner nozzle according to claim 1. The invention may also be embodied in a method for vacuum cleaning according to claim 14.

By leaving the rim portion in the lowered position during a portion of the stroke and subsequently, during a later portion of the stroke, starting the lifting to the lifted position, a large vacuum is maintained during a portion of the stroke. Thus, the pressure drop through the gap between the rim and the floor surface remains relatively high so that air velocities in that area remain relatively high, which causes fine dust and other dirt adhering to a floor surface to be entrained relatively effectively. After a certain amount of larger particles have or may have been gathered in front of a leading rim portion, lifting that rim portion is sufficient to allow the leading rim to pass over these larger particles, so that these larger particles reach the inside of the contour of the outer end of the inlet and are entrained through the inlet. Accordingly, a relatively strong vacuum inside the outer end of the inlet and a large pressure drop across the passage between the rim and the floor surface is made available except when the rim or a portion of the rim is lifted for letting in larger particles.

Particular elaborations and embodiments of the invention are set forth in the dependent claims.

Further features, effects and details of the invention appear from the detailed description and the drawings.

BRIEF DESCRIPTION OF THE DRAWINGS

FIG. 5 is a perspective top view of a robotic vacuum cleaner nozzle;

DETAILED DESCRIPTION OF THE EMBODIMENTS

Figure 3:
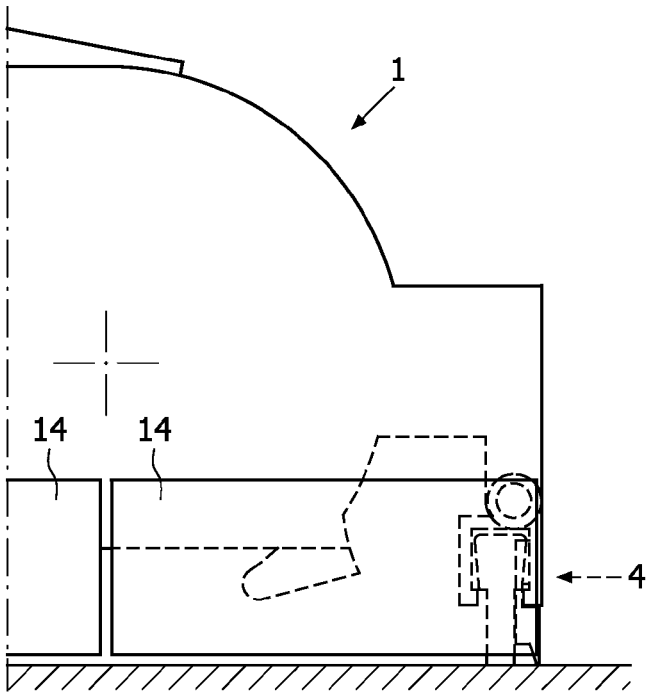
FIG. 3 is a side view of the vacuum cleaner nozzle of FIGS. 1 and 2 with the rims in lowered positions.
Figure 4:
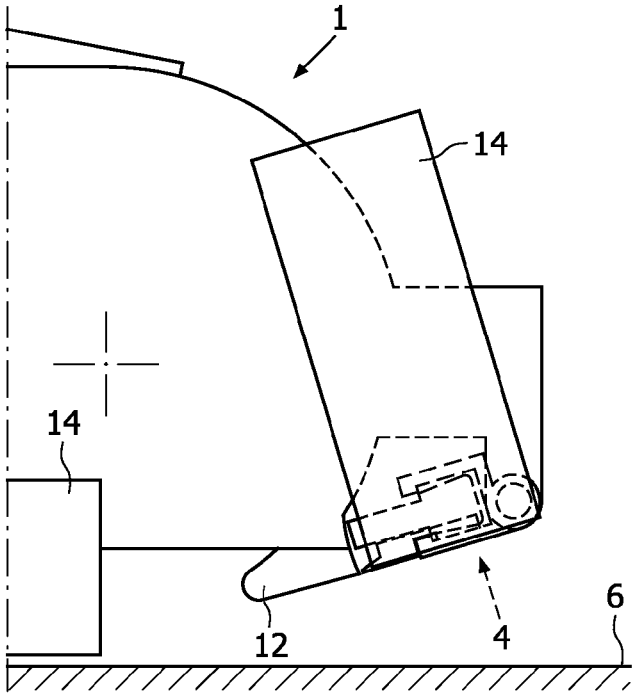
FIG. 4 is a side view of the vacuum cleaner nozzle of FIGS. 1-3 with a rim in a lifted position.
Figure 5:
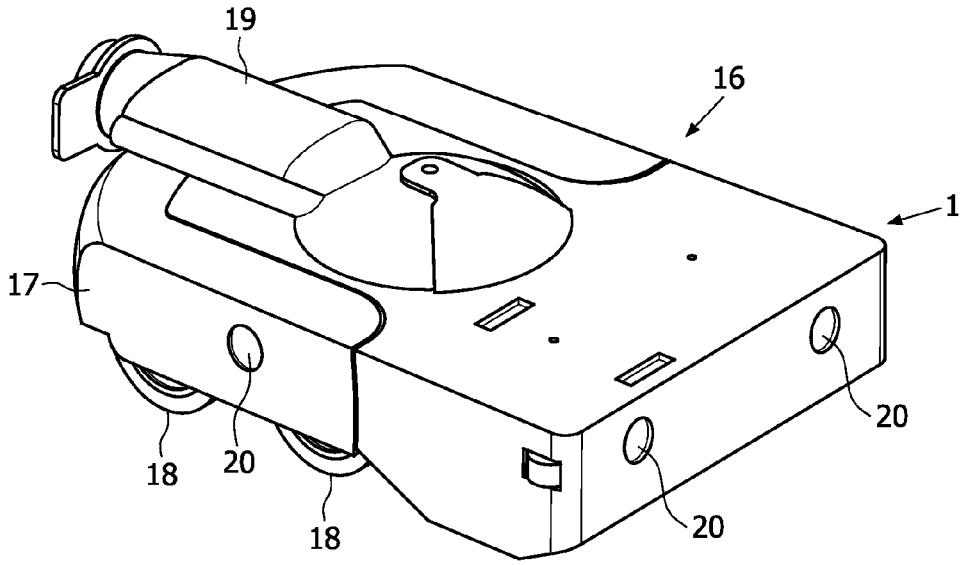
FIG. 5.
Figure 6:
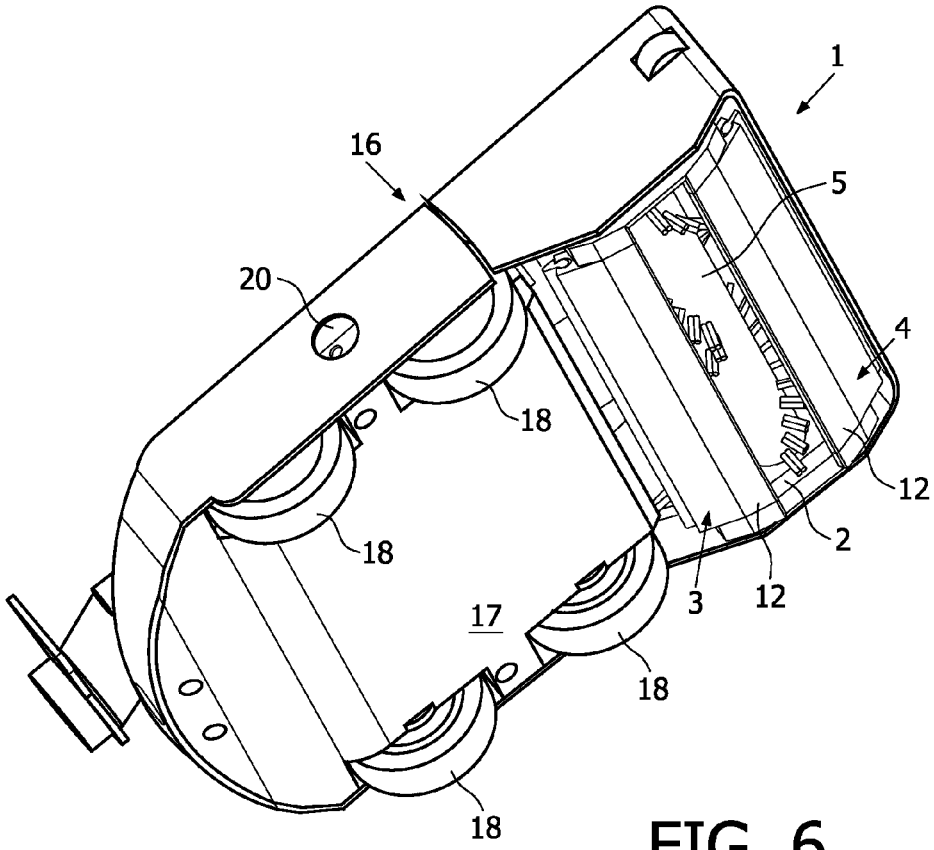
FIG. 6 is a perspective bottom view of the robotic vacuum cleaner nozzle of FIG. 7 is a bottom view of an alternative example of a vacuum nozzle according to the invention.

The invention is mainly described with reference to an example of a vacuum cleaner nozzle 1 according to the invention shown in FIGS. 1-4. Such a vacuum nozzle 1 can for example be part of a robotic vacuum cleaner of which a robotic vacuum cleaner head unit 16 is shown in FIGS. 5 and 6.

The vacuum cleaner nozzle 1 bounds an inlet 2 for guiding aspirated air through the nozzle 1. The aspirated air can be transported towards for example a hose and/or to a dust bag in a canister unit of the vacuum cleaner via an air outlet 22. A rotating cleaning brush 5 is arranged such that outer ends of the brush hairs extend into inlet 2.

Figure 1:
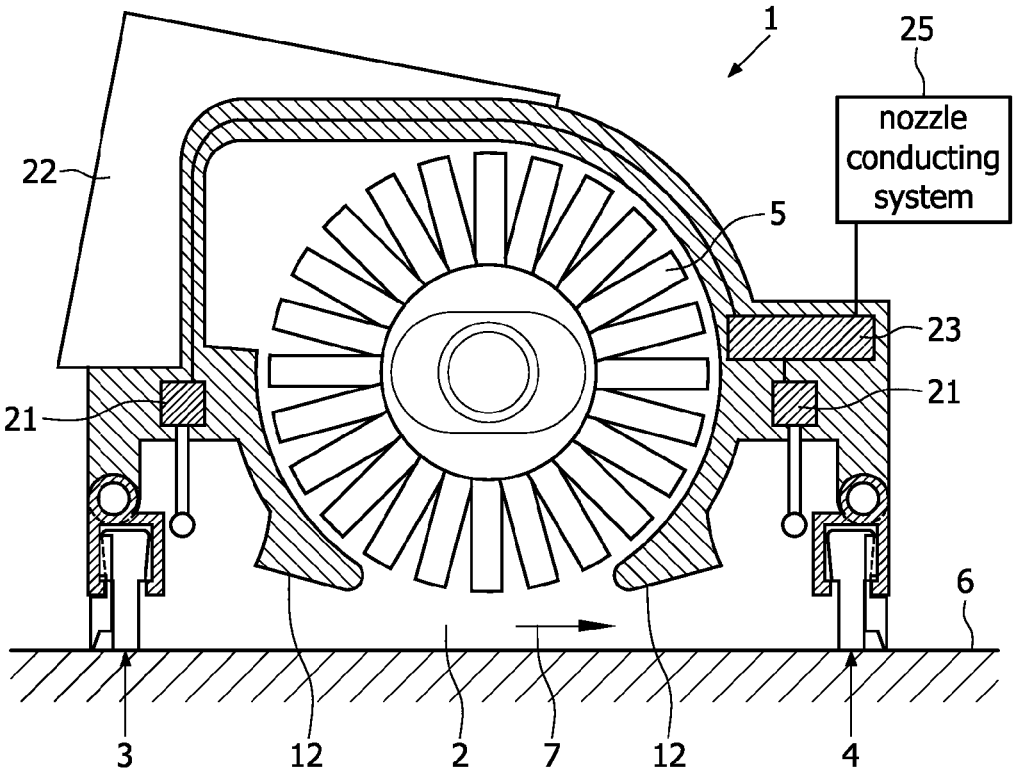
FIG. 1 is a sectional side view of an example of a vacuum cleaner nozzle according to the invention with rims in lowered positions.

A first rim portion 3 and a second rim portion 4 extend on opposite sides along the outer contour of the inlet 2. Both rim portions 3, 4 are movable between a lowered position for contacting the floor surface 6 or extending close to the floor surface 6, as is shown in FIGS. 1 and 3, and a lifted position for leaving a spacing between the rim portion 4 and the floor 6, as is shown in FIGS. 2, 4 and 6.

A rim operating structure is provided for lifting a rim portion 3, 4 from the lowered position to the lifted position. In the nozzle according to the present example, the rim operating structure is constituted by solenoids 21 that are connected to a nozzle control unit 23 for controlling displacements of the rim portions 3, 4 between the lifted and the lowered positions. However, instead of solenoids, many other types of actuators, such as electric motors or members operated by selective application of the vacuum in the inlet area thereto.

The rim operating structure 21, 23 is also arranged for displacing both rim portions 3, 4 together between the lifted and the lowered position for adaptation of the vacuum nozzle 1 to the vacuum cleaning of carpets and the like. The operating structure 21, 23 may for example be adapted to act on data provided by a sensor indicating the type of floor surface being cleaned.

Figure 2:
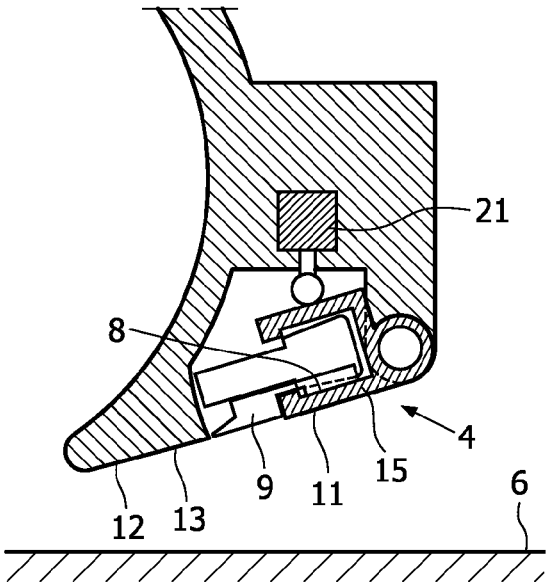
FIG. 2 is an enlarged portion of FIG. 1 with the rim in a lifted position.

For cleaning soft floor surfaces such as carpets, both rim portions 3, 4 can be set in a lifted position (FIG. 2, 4, 6). This allows the vacuum nozzle 1 to move towards the floor 6 relative to a drive unit 17 of the head unit, so that skid surfaces 12 contact the floor surface 6 when the rim portions 3, 4 are in the lifted position. Thus, when vacuuming a soft floor surface, the skid surfaces 12 will at least partially carry the vacuum nozzle.

When vacuuming hard floor surfaces, like for example tiles and wood, both rim portions 3, 4 are set in the lowered position, contacting the floor surface area 6 when the vacuum nozzle 1 is in an operating position on the floor surface 6.

When vacuum cleaning a floor surface, it is usual to pass over the entire surface by moving the vacuum cleaning nozzle over the floor surface in a pattern of movement including a number of movement strokes, each being constituted by a movement in a given direction. Successive strokes may be in generally opposite directions parallel to each other and each being slightly offset relative to the previous stroke and partially overlapping the previous stroke, but some or all of the strokes may be in directions at other angles relative to each other. The rim operating structure 21, 23 is adapted for leaving the rim portion 3, 4 in the lowered position during a portion of a stroke and for subsequently, during a later portion of the stroke, starting the lifting of the rim portion to the lifted position.

By leaving the rim portion 3, 4 in the lowered position during a portion of the stroke, and thus restricting the passage between the nozzle 1 and the floor 6 via which air can enter the inlet 2, a substantial under pressure is created in the inlet 2. This creates a high velocity air flow between the rim portions 3, 4 and the floor surface 6 and enhances a brushing effect of the rim portions 3, 4, since the vacuum pulls the nozzle 1, and thus the rim portions 3, 4, against the floor 6. This is advantageous for effectively removing fine dirt and dirt adhering to the floor. Subsequently, during a later portion of the stroke, lifting the rim portion 3, 4 to the lifted position allows larger particles to be drawn into the inlet and to be entrained in the air flow via the outlet 22.

The portion or portions of the stroke during which the rim portions 3, 4 are left in the lowered position preferably include an initial portion of the stroke, so that during a stroke, a leading one of the rim portions 3, 4 is lifted only after there is a reasonable likelihood that one or more larger particles may have accumulated in front of that rim portion 3, 4.

For example, when cleaning a hard floor surface 6, during an initial portion of a stroke in a direction indicated by an arrow 7, both the rim portions 3, 4 are in the lowered position shown in FIG. 1. During the stroke, particles that are too big to pass under the lowered rim portions 3, 4 accumulate in front of the leading rim portion 4 of the vacuum nozzle 1 and are pushed forward by it.

Then, during a later portion of the stroke, one of the rim actuator 21 lifts the leading rim portion 4 into the lifted position so that a spacing between the floor surface 6 and the rim portion 4 is created, causing larger particles that have accumulated in front of the leading rim portion 4 during this stroke to enter the contour of the outer end of the inlet 2, while the nozzle 1 continues to move over the floor. Thus, temporarily, an entrance for larger particles is created by lifting the leading rim portion 4, while the trailing rim portion 3 remains in its lowered position. The nozzle 1 does not have to be lifted from the floor surface 6 and positioned over larger particles to be able to aspirate the larger particles and a reduced vacuum in the inlet 2 only occurs temporarily while nevertheless the larger particles are caused to enter the inlet area 2. While the leading rim portion 4 is in its lifted position, the other rim portion 3, that remains in its lowered position, keeps the nozzle 1 lifted sufficiently far from the floor surface 6 to avoid that the skid surfaces 12 touch the floor.

When the vacuum nozzle 1 is moved in a direction opposite to the one indicated by the arrow 7, the rim portion 3 will be the leading rim portion and will be the rim portion that is lifted while the, then trailing rim portion 4 remains in its lowered position.

Preferably, the rim operating structure 21 only temporarily lifts one of the rim portions 3, 4, just long enough for letting the larger particles that have accumulated in front of the leading one of the rim portions 3, 4 into the inlet 2, and is subsequently lowered again to regain the high vacuum level allowing fine dust and other dirt adhering to the floor surface 6 to be removed effectively.

The moment when lifting of the leading rim portion 3, 4 is started is preferably determined in relation to an expected end of the stroke, for instance by determining when the nozzle is at a predetermined distance from the expected end of the stroke or by determining a point in time that is a predetermined period of time before the expected end of the stroke. In turn, the expected end of the stroke may for instance be determined from a sensed obstacle or change in the type of floor surface in a current direction of movement of the vacuum nozzle 1, or be determined from changes in the speed at which the vacuum nozzle 1 is travelling, a reduction of the speed indicating the imminent end of a stroke.

Thus, the rim portion 3, 4 is be lifted before the stroke is ended and the cleaning nozzle changes its direction of movement, for example by cornering an obstacle or reversing its direction of movement. During the stroke, a strong vacuum is maintained while the larger particles are first accumulated in front of the leading rim portion 3, 4 and subsequently caused to enter the vacuum nozzle 1 by lifting the leading rim portion 3, 4 only once, at the end of the stroke. If the rim portion 3, 4 is lifted near or at the end of a stroke, a maximum amount of particles will have gathered in front of the leading rim portion 3, 4 when the vacuum level in the nozzle 1 is temporarily allowed to drop to allow the larger particles to enter the nozzle 1.

The start of the lifting of the leading rim portion 3, 4 may also be determined in relation to a beginning of a stroke, for example by measuring a covered distance, and/or the elapse of a specified period of time from the start of a stroke. By keeping the length of the portion of a stroke during which the rim portion 3, 4 is left in its lowered position limited, it is counteracted that too many particles accumulate in front of the vacuum nozzle 1 before the rim portion 3, 4 is lifted and the risk of large particles slipping to the side of the vacuum nozzle 1 and are left behind before the leading rim portion 3, 4 is lifted is reduced.

Also, the rim portion 3, 4 may be simply lifted each time a certain distance has been covered, or a certain time interval has past. The duration of lifting the leading rim portion may for instance be, for each occasion, a predetermined period of time and/or covered distance of displacement of the nozzle 1 over the floor, or a percentage of the time or distance traveled before the rim portion 3, 4 was lifted.

Furthermore, a combination of the above-mentioned control options is also possible. The leading rim portion 3, 4 can for example be lifted each time the vacuum nozzle 1 has traveled 2 meters and at end of each stroke.

The control unit 23 may also be arranged to lift the leading one of the rim portions 3, 4 in response to a signal caused by a rim lift command from a user.

In the present example, the control unit 23 is connected to a nozzle conducting system 25 of a robotic vacuum cleaner. Such a nozzle conducting system contains data representing a track to be followed by the head unit 16. Because in such a system 25, the movements of the nozzle are generally predetermined (at least if no unforeseen obstacle is encountered), it is relatively simple to determine moments to lift the leading rim portion for allowing large particles to enter the nozzle 1 in such a manner, that the larger particles are caught effectively, yet the time and distance traveled over which the leading rim portion is lifted is kept very low. For instance, because the end of a stroke is known in advance, the leading one of the rim portions 3, 4 may then for instance be lifted automatically and very briefly yet long enough to catch the accumulated particles during a final portion of each stroke.

In the example shown, the first rim portion 3 or the second rim portion 4 is each time lifted as a whole. Alternatively, the rim portions may be subdivided in for example separately liftable rim parts or the rim may be flexible and the rim operating structure may be arranged for individually lifting parts or portions of the rim or rims.

In the example shown in FIGS. 1 and 2, the rim portion 3 is positioned along a first side of the contour of the outer end of the inlet 2 and the other rim portion 4 is positioned along a side of the contour of the outer end of the inlet 2 opposite the first side. In this way both rim portions 3, 4 alternately can function as the leading rim portion if the vacuum nozzle 1 is moved to and fro.

The rim portions 3, 4 are U-shaped in bottom view and also extend along the sides of the vacuum nozzle 1. As is best seen in FIG. 3, when in a lowered position, side flaps 14 of the rim portions 3, 4 extend along the sides of the vacuum nozzle 1. This is advantageous for obtaining an increased vacuum in the inlet 2 when vacuum cleaning hard floors. When the rim portion 3, 4 is in its lifted position, shown in FIG. 4, the side flaps 14 point upwards along the side of the vacuum nozzle 1. This allows large particles that have accumulated against a wall or that have slipped to the side of the vacuum cleaner nozzle 1 to be drawn into the inlet 2 effectively.

As is best seen in FIG. 2, the rim portion 4 is hingedly suspended and is in this position pivoted inwardly from the lowered position of the rim portion 4, shown in FIG. 1 to its lifted position. Because the rim portion 4 pivots inwardly when moving from its lowered position towards its lifted position, it is avoided that particles accumulated in front of the rim portion 4 are moved away from the nozzle 1 when the rim portion 4 is lifted. Moreover, it is counteracted that particles stay clinging to the outside of the rim portion 4 since the rim portion moves away from the accumulated particles when being lifted and during and after lifting a strong air flow along the outer surface of the rim portion 4 is caused which is advantageous for entraining any particles clinging to the outside of the rim portion 4.

In its lifted position, the rim portion 4 is oriented along the bottom surface of the suction inlet 2. Thus, the vacuum nozzle 1 can remain relatively compact compared to a nozzle storing the rim portion in a vertical position.

The rim portion 4 has a guide surface 11 facing outwardly from the nozzle 1 when the rim portion 4 is in its lifted position. The guide surface 11 preferably extends at an angle of 5-30° and more preferably 10-20° relative to a plane defined by the contour of the inlet 2. The inner end of the guide surface 11 projects further in a direction perpendicular to that plane than the outer end of the guide surface, such that the inner end of the guide surface 11 is closer to the floor surface 6 than the outer end of the guide surface 11 when the nozzle 1 is in the operating position. Thus the guide surface 11 of the rim portion 4 allows the nozzle 1 to slide over particularly large particles in a similar manner as a ski so that such particles also reliably reach the inlet 2. Also, when vacuuming soft surfaces, with both rim portions in a lifted position, the guide surface 11 allows the nozzle to slide over larger particles and undulations in the surface.

The rim portion 4 includes a strip-shaped brush 8 and a strip 9 that is continuous in its longitudinal direction and extends along the brush 8. The guide surface 11 includes a surface of the strip 9 facing away from the brush 8, when the rim portion 4 is in the lifted position. The strip 9 protects the brush and preferably is made of a flexible, low friction material for sliding over particles and floor surfaces. The brush 8 and the strip 9 are held in a holder 15, which holder also provides a portion of the guiding surface 11 for guiding the nozzle 1 over larger particles when the rim portion 4 is in its lifted position.

Furthermore, a guide surface 13 of the skid plate 12 for contacting the floor surface when the whole rim portion 4 is in the lifted position, is flush with the guide surface 11 of the rim portion 4 in its lifted position, thus complementing each other and allowing the nozzle 1 to slide smoothly over larger particles so that such particles are reliably aspirated.

FIGS. 5 and 6 illustrate how the nozzle 1 shown in FIGS. 1-4 may be integrated in a self propelled, self-steering vacuum cleaner head unit 16. Such a head unit is part of a robotic canister vacuum cleaner further including a self propelled, self-steering vacuum fan module and a hose assembly (both of which are not shown). An example of a robotic vacuum cleaner having a head unit connected to a vacuum fan module via a hose is disclosed in International Patent Application WO 02/074150.

The robotic vacuum cleaning head unit 16 has a drive system 17, comprising a drive and wheels 18 for propulsion and steering. In the embodiment shown, the drive system 17 is located at a rear end of the robotic cleaning head unit 16, while the vacuum nozzle 1 is located at the front end.

The inlet 2 and the rim portions 3, 4 of vacuum nozzle 1 are shown in the bottom view shown in FIG. 6. The rim portions 3, 4 are shown in their lifted positions and the side flaps 14 shown in FIGS. 3 and 4 are not shown. A hose connection tube 19 extends from the vacuum nozzle 1 to the rear of the robotic cleaning head unit 16 for connecting the air outlet 22 of the vacuum nozzle 1 with one end of a hose assembly (not shown).

The robotic head unit 16 has sensors 20 for providing information about boundaries and obstacles in its surroundings. In addition, the sensors 20 can for example be used to determine the type of surface that is being cleaned, etc. The sensors are coupled to the nozzle conducting system 25 (FIG. 1).

Data regarding the surroundings can be provided to the nozzle conducting system 25 for processing and route planning. For example, for cleaning a rectangular floor area, the control system of the robotic vacuum cleaner may, based on data provided by the sensors 20, map out a pattern of overlapping strokes, parallel to a border of the area, forming a track to be followed by the robotic head unit 16 and determining where the leading rim portion is to be lifted. Preferably the mapping and planning is done by the vacuum-fan module (also having sensors), which module subsequently sends the corresponding control signals to the cleaner head unit.

Because a robotic vacuum head unit 16 is often wider than the vacuum nozzle 1, many robotic vacuum cleaners are not able to vacuum up to for example a wall. There will always be a small area along the wall, which cannot be vacuumed. In an alternative embodiment according to the invention, the rim portions along the side of the vacuum nozzle may be independently moveable. For example, when following a track closely parallel to a wall, the rim portion facing the wall may be lifted to provide extra suction power for sucking in particles lying on the area out of direct reach of the vacuum nozzle.

Alternatively or additionally, when the vacuum nozzle 1 ends a stroke with the frontal rim portion 3, 4 facing the wall, lifting the rim portion 3, 4 prior to reaching the end of the stroke prevents particles being pushed on the area out of reach of the vacuum nozzle 1. Also, keeping the rim portion 3, 4 in a lifted position until the end of the stroke causes an intensive air flow from the wall to the inlet 2 along the floor 6 that causes a substantial portion of the particles lying close to the wall to be entrained into the inlet 2.

Furthermore, the sensors 20 of the robotic vacuum cleaner head unit 16 can for example also be used for locating larger particles in advance, such that the rim portion 3, 4 can be lifted prior to reaching the particles, preventing that the particles are pushed forward by the vacuum nozzle 1, possibly hampering the steering and/or speed of the robotic head unit 16, prior to being picked up.

While the invention has been illustrated and described in detail in the drawings and foregoing description, such illustration and description are to be considered illustrative or exemplary and not restrictive; the invention is not limited to the disclosed embodiments.

Figure 7:
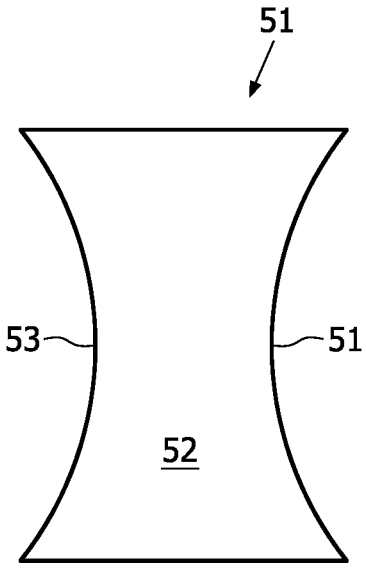

For instance, as shown in FIG. 7, when seen in bottom view, the rim portions 53, 54 of the nozzle 51 bounding the inlet 52 may extends along a curved (rim portion 54) and/or V-shaped (rim portion 54) trajectory, a central section of the rim portion 53, 54 being located inwardly relative to outer sections of the rim portion 53, 54. Thus, larger particles are effectively kept in front of the leading rim portion 53, 54 while the nozzle 51 moves during the portion of the stroke prior to lifting of the rim portion 53 or 54, so that larger particles engaged by the rim portion 53, 54 remain in front of the nozzle 51 and are reliably aspirated when the rim portion 53, 54 is temporarily lifted. In this example the rim portions 53 and 54 are of different shapes for illustrative purposes. Generally, it will be preferred that both the rim portions 53, 54 are of generally the same shape.

Also, it is possible to each time lift the entire rim portion, preferably briefly if a support, such as a set of wheels, is provided that keeps the nozzle lifted to keep the space between the nozzle with the entire lifted rim and the floor wide enough to allow the larger particles to enter. This causes a relatively strong increase of the air displacement per unit of time through the inlet, which is advantageous for effectively entraining heavy particles through the inlet and may be effected using a more simple rim operating structure that is capable of lifting the entire rim only. It is also possible that only a single moveable rim is positioned along only a part of the contour.

Also, it is for example possible that the rim portions in lifted position not only form a guide surface, but also function as skid surfaces, making separate skid surfaces unnecessary, for at least partially carrying the nozzle when vacuuming soft floor surfaces.

Furthermore, a vacuum nozzle according to the invention can also be used without a cleaning brush 5, as part of a non-robotic vacuum cleaner or as part of a robotic vacuum cleaner in which the vacuum cleaner nozzle, the canister and the fan are integrated in a single self-propelled and self-steering unit.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. Any reference signs in the claims should not be construed as limiting the scope.

The invention claimed is:

1. A vacuum cleaner nozzle bounding an inlet for guiding aspirated air through the nozzle, the nozzle comprising:

a rim along an outer end contour of the inlet for contacting a floor surface area when in an operating position on the floor surface, wherein at least a leading rim portion of the rim is movable between (i) a lowered position for contacting a floor surface or extending close to the floor surface, and (ii) a lifted position for leaving a spacing, or at least a larger spacing, between the rim portion and the floor surface, wherein the leading rim portion is hingedly suspended, and wherein the leading rim portion, when in the lifted position, is in a position pivoted inwardly towards the inlet from the lowered position of the leading rim portion; and a rim operating structure for lifting and lowering, during a movement stroke of the nozzle over the floor surface in a given direction, the leading rim portion between the lowered position and the lifted position;

wherein the rim operating structure is adapted for leaving the leading rim portion in the lowered position during a portion of the movement stroke of the nozzle over the floor surface in the given direction and for subsequently, during a later portion of the movement stroke in the given direction, starting the lifting of the leading rim portion to the lifted position.

2. The vacuum cleaner nozzle as claimed in claim 1, wherein the rim operating structure is adapted for determining a moment for the start of the lifting of the leading rim portion in relation to an expected end of the stroke.

3. The vacuum cleaner nozzle as claimed in claim 1, wherein the rim operating structure is adapted for determining a moment for the start of the lifting of the leading rim portion in relation to a beginning of the stroke.

4. The vacuum cleaner nozzle as claimed in claim 1, wherein the rim operating structure is adapted for, each time, keeping the leading rim portion in the lifted position for a predetermined period of time or over a predetermined distance of displacement of the nozzle over the floor.

5. The vacuum cleaner nozzle as claimed in claim 1, wherein, in the lifted position, the leading rim has a guide surface facing outwardly from the inlet and extending at an angle of 5-30° relative to a plane defined by the contour of the inlet, an inner end of the guide surface projecting further in a direction perpendicular to said plane than an outer end of the guide surface, such that, when the nozzle is in the operating position, the inner end of the guide surface is closer to the floor surface than the outer end of the guide surface.

6. The vacuum cleaner nozzle as claimed in claim 5, wherein said vacuum cleaner nozzle further comprises a skid plate for contacting the floor surface when the whole rim is in the lifted position, the skid plate having a guide surface in line with the guide surface of the leading rim in the lifted position.

7. The vacuum cleaner nozzle as claimed in claim 5, wherein the leading rim comprises a strip-shaped brush and a strip that is continuous in its longitudinal direction and extends along the brush, and wherein, when the leading rim is in the lifted position, the guide surface at least includes a surface of the strip facing away from the brush.

8. The vacuum cleaner nozzle as claimed in claim 1, wherein the leading rim portion is positioned along a first side of the contour of the outer end of the inlet, and a further rim portion is positioned along a side of the contour of the outer end of the inlet opposite the first side of the contour.

9. The vacuum cleaner nozzle as claimed in claim 8, wherein the leading rim portion is moveable independently of the further rim portion.

10. The vacuum cleaner nozzle as claimed in claim 1, wherein, seen in bottom view, the leading rim portion extends along a curved and/or V-shaped trajectory side of the contour of the outer end of the inlet, a central section of the leading rim portion being located inwardly relative to outer sections of the leading rim portion.

11. The vacuum cleaner nozzle as claimed in claim 1, wherein the at least one leading rim portion further comprises a side flap that extends along a side of the vacuum nozzle.

12. A robotic vacuum cleaner comprising a self propelled, self-steering unit comprising a nozzle according to claim 1, a unit conducting system containing data representing directions determining a track to be followed by the unit, and wherein the rim operating structure is adapted for determining when to lift the rim portion from the data representing directions determining a track to be followed by the unit.

* * * * *